US007324125B2

(12) United States Patent
Gustafsson

(10) Patent No.: US 7,324,125 B2
(45) Date of Patent: Jan. 29, 2008

(54) METHOD FOR AUTOMATIC ADJUSTMENT OF MEDIA SETTINGS FOR A PRINTER

(75) Inventor: Peter Gustafsson, Kallered (SE)

(73) Assignee: Intermec IP Corp., Everett, WA (US)

( * ) Notice: Subject to any disclaimer, the term of this patent is extended or adjusted under 35 U.S.C. 154(b) by 205 days.

(21) Appl. No.: 11/301,307

(22) Filed: Dec. 12, 2005

(65) Prior Publication Data

US 2006/0158683 A1 Jul. 20, 2006

Related U.S. Application Data

(60) Provisional application No. 60/635,388, filed on Dec. 10, 2004.

(51) Int. Cl.
*B41J 2/36* (2006.01)

(52) U.S. Cl. ..... 347/193; 400/120.13

(58) Field of Classification Search ..... 347/188, 347/193; 400/120.09, 120.13
See application file for complete search history.

(56) References Cited

U.S. PATENT DOCUMENTS

| | | | | |
|---|---|---|---|---|
| 3,787,881 | A | 1/1974 | Duffield | 346/75 |
| 3,975,707 | A | 8/1976 | Ito et al. | 346/76 |
| 4,567,488 | A | 1/1986 | Moriguchi et al. | 346/76 |
| 4,592,893 | A | 6/1986 | Poppe et al. | 422/56 |
| 4,661,001 | A | 4/1987 | Takai et al. | 400/103 |
| 4,699,531 | A | 10/1987 | Ulinski, Sr. et al. | 400/74 |
| 4,741,045 | A | 4/1988 | Denning | 382/9 |
| 4,762,063 | A | 8/1988 | Yeagle | 101/93.01 |
| 4,795,281 | A | 1/1989 | Ulinski, Sr. et al. | 400/74 |
| 4,824,266 | A | 4/1989 | Fujii et al. | 400/120 |
| 4,831,610 | A | 5/1989 | Hoda et al. | 369/48 |
| 4,864,112 | A | 9/1989 | Imai et al. | 235/463 |
| 4,870,428 | A | 9/1989 | Kuwabara et al. | 346/76 |
| 4,937,590 | A | 6/1990 | Robillard et al. | 346/76 |
| 5,007,748 | A | 4/1991 | Lee et al. | 400/103 |
| 5,023,437 | A | 6/1991 | Speicher | 235/432 |
| 5,056,429 | A | 10/1991 | Hirosaki | 101/93.01 |
| 5,089,691 | A | 2/1992 | Morisaki et al. | 235/375 |
| 5,149,212 | A | 9/1992 | Murakami | 400/121 |

(Continued)

FOREIGN PATENT DOCUMENTS

EP 0 329 369 2/1989

(Continued)

OTHER PUBLICATIONS

Bassetti, L.W., et al., "Print Enhancement or Laser Printers," *IBM Technical Disclosure Bulletin* 27(5): 3071-3072, Oct. 1984.

(Continued)

*Primary Examiner*—Huan Tran
(74) *Attorney, Agent, or Firm*—Seed IP Law Group PLLC

(57) ABSTRACT

A method for automatically adjusting the setting of a thermal printer when a new roll of media is inserted in the printer. A maximum and a minimum energy needed to print are determined. This information is used to determine a coarse energy setting. The printer next performs a series of adjustments to find the optimal setting. The optimal setting is used to set the printer automatically.

16 Claims, 2 Drawing Sheets

U.S. PATENT DOCUMENTS

| | | | | |
|---|---|---|---|---|
| 5,183,343 | A | 2/1993 | Tazawa et al. | 400/103 |
| 5,206,490 | A | 4/1993 | Petigrew et al. | 235/462 |
| 5,247,371 | A | 9/1993 | Hikawa et al. | 358/448 |
| 5,366,307 | A | 11/1994 | McGourty et al. | 400/708 |
| 5,376,806 | A | 12/1994 | Hejazi | 250/584 |
| 5,404,411 | A | 4/1995 | Banton et al. | 382/54 |
| 5,415,479 | A | 5/1995 | Kuhn et al. | 400/104 |
| 5,488,223 | A | 1/1996 | Austin et al. | 235/375 |
| 5,537,515 | A | 7/1996 | Yokoyama et al. | 395/109 |
| 5,563,986 | A | 10/1996 | Suzuki | 395/114 |
| 5,564,841 | A | 10/1996 | Austin et al. | 400/103 |
| 5,625,399 | A | 4/1997 | Wiklof et al. | 347/195 |
| 5,633,488 | A | 5/1997 | Spitz | 235/462 |
| 5,676,473 | A | 10/1997 | Wright, IV et al. | 400/103 |
| 5,681,120 | A | 10/1997 | Ackley | 400/103 |
| 5,767,889 | A | 6/1998 | Ackley | 347/171 |
| 5,804,342 | A | 9/1998 | Paz-Pujalt et al. | 430/19 |
| 5,841,954 | A | 11/1998 | Ackley | 395/108 |
| 5,843,599 | A | 12/1998 | Paz-Pujalt et al. | 430/17 |
| 6,042,279 | A | 3/2000 | Ackley | 400/103 |
| 6,665,089 | B1 * | 12/2003 | Austin et al. | 358/1.18 |
| 2002/0126197 | A1 * | 9/2002 | Minowa et al. | 347/193 |
| 2004/0008365 | A1 * | 1/2004 | Hobbs | 358/1.15 |

FOREIGN PATENT DOCUMENTS

| | | |
|---|---|---|
| GB | 2 228 450 | 8/1990 |
| JP | 60-73852 | 4/1985 |
| JP | 61-22960 | 1/1986 |

OTHER PUBLICATIONS

*Microsoft Press Computer Dictionary*, Microsoft Press, Redmond, Washington, 1997, p. 43.

* cited by examiner

METHOD FOR AUTOMATIC ADJUSTMENT OF MEDIA SETTINGS FOR A PRINTER

The present invention claims the benefit of U.S. Provisional Application No. 60/635,388 filed Dec. 10, 2004 and entitled "Method for Automatic Adjustment of Media Settings for a Printer."

BACKGROUND OF THE INVENTION

1. Field of the Invention

The present invention relates to a method of adjusting the settings of a thermal printer. Specifically, it relates to a method of automatically adjusting the settings for a specific media.

2. Description of Related Art

When a new type or roll of media is installed in a printer, the printer settings need be adjusted in order to obtain the best print quality for that media.

Prior art methods of adjusting printer settings for new media involve either looking up recommended settings for a particular media in tables provided by the manufacturer and manually inputting those settings, manual trial and error of various settings by an operator or a combination of these two methods. The recommended settings listed in a table are an estimate or approximation of the best print settings for a particular type of media, but are not able to take into account individual variations in the media based on, for example, manufacturing conditions, storage, and starting materials. Nor do the recommended settings listed take into account variations due to an individual printer, printerhead wear, ribbon wear, etc.

Prior art solutions based on human interaction and/or judgment may not result in the optimal settings. Further, prior art solutions based on human judgment will not give repeatable results because each operator may have a different view. Thus, there is a need for an automatic method for adjusting the printer settings for a new media.

SUMMARY OF THE INVENTION

A thermal printer having a black-mark sensor or a separate sensor on the print side of the media is used to automatically adjust the media settings. There are two primary steps. First, a coarse energy setting is found. Second, the energy setting is the fine-tuned. Each primary step involves a series of repeated sub-steps.

By performing the following test sequence an approximate or coarse setting for an unknown media may be chosen.

A black box is printed over full label width. The pattern has a low energy setting for a number of dots in length (x dots), then the energy is raised for the next x dots until the medium safe level for any media is reached. Then the media is backed into the printer and the expected position of an energy change is calculated. The media is single stepped out of the printer and the black-mark sensor readings are sampled.

If no change is detected, there has been no change of paper reflection i.e. it is still white (too low energy). If there is a change detected, the minimum energy needed to make a print has been found.

The procedure is repeated until the next field does not change and detected the maximum useful energy level.

By repeating this method between minimum energy and maximum energy settings a coarse energy setting is interpolated.

The energy setting is next fine-tuned. By performing the following test sequence an optimal setting for an unknown media can be identified. The optimal setting is the setting where the printer provides the most ink for the least energy so that the printout is at the maximum sharpness.

A black box is printed using the coarse setting. The black box should have a width larger than the black-mark sensor beam. A step-by-step sampling of the leading and trailing edge of the box is undertaken to obtain a gradient curve for leading and trailing edge of the printout. Based on the leading and trailing edge slopes, an adjustment is made to find the optimum point for balancing them against each other. The printing, sampling and adopting steps are repeated until optimum point has been found. The printer is set to the found optimum value.

DETAILED DESCRIPTION OF THE INVENTION

Figure 1:
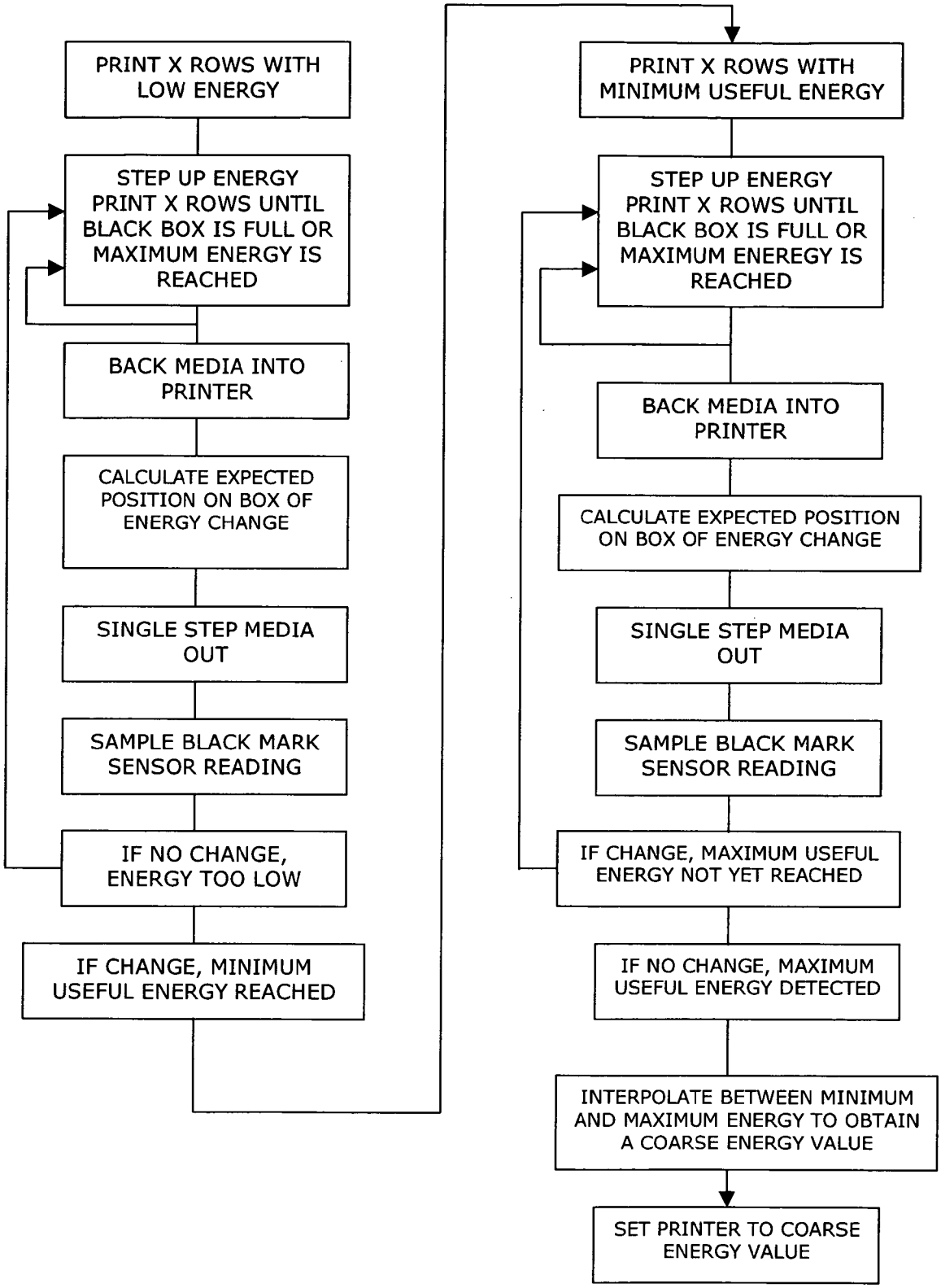
FIG. 1 is a flow chart of a method for determining a coarse energy setting.
Figure 2:
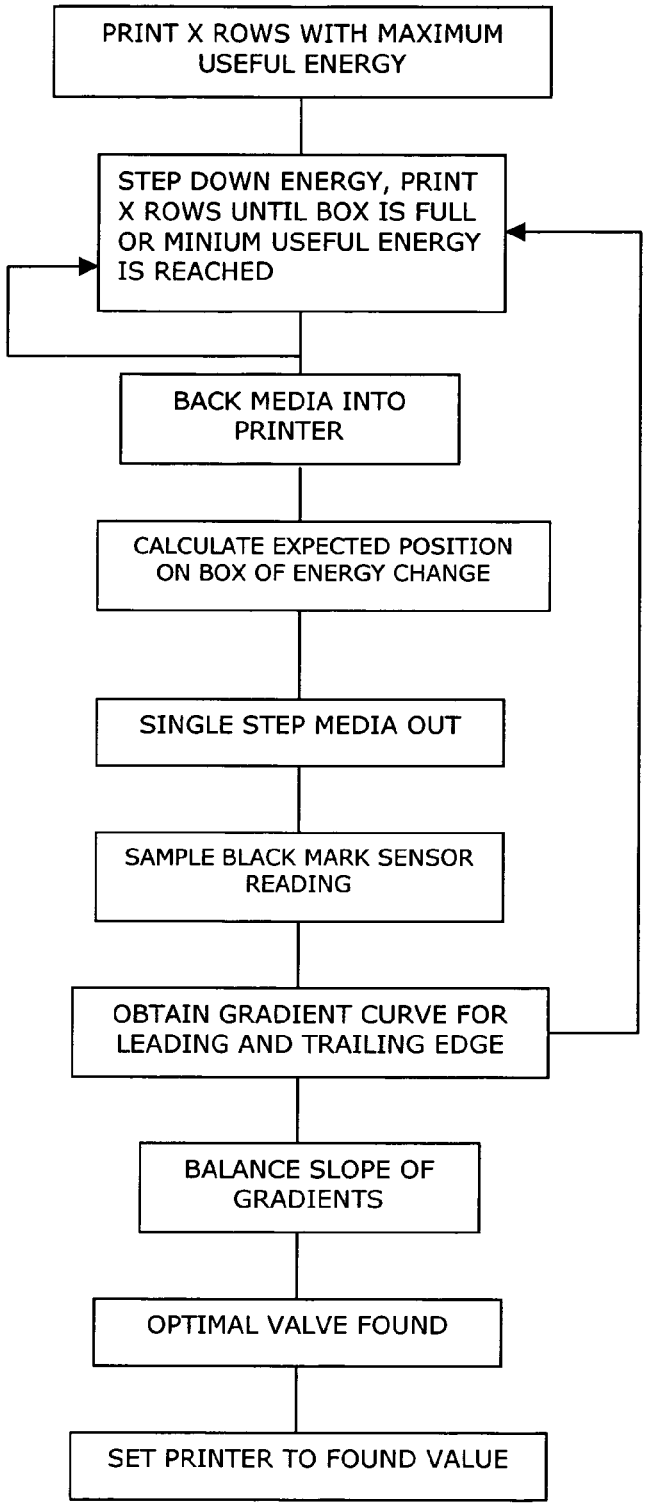
FIG. 2 is a flow chart of a method of fine-tuning the energy setting.

A method of automatically setting a printer to the optimal printer settings. The optimal printer setting is the setting where the printer prints with optimum black, i.e. most black for least energy so that the printout is at maximum sharpness, i.e. contained in the expected dot area, not too small and not too large.

A thermal printer having a reflective sensor capable of detection of reflectance properties referred to as a black-mark sensor or another sensor on the print side of the media is used to measure the print and then the media settings of the printer are automatically adjusted based on the measurements. The sensor can be part of the printer or a separate sensor.

There are two steps, each sub step involves a series of repeated sub-steps. In step one, a coarse energy setting is determined. In step two, the energy setting is the fine-tuned to find the optimal setting.

It is not necessary to know what media is being used in order to set the printer using the inventive method. Thus, the inventive method is useful for unknown media.

By performing the following test sequence an approximate or coarse setting for a media may be obtained.

First, a black box is printed full label width. The pattern has a low energy setting for a desired number of dots in length or a desired length of the label (x rows), then the energy is raised for the next x rows, the energy is raised again for the next x rows and so forth until the label is fully printed or until the maximum safe level for any media is reached. The media is then backed into the printer and the expected position of an energy change is calculated. Once the expected position is calculated, the media is single stepped out of the printer again and the black-mark sensor readings are sampled by the sensor. If no change is detected, there has been no change of paper reflection i.e. the paper is still white and the energy setting is too low. If there is a detected change in the sensor readings, the minimum energy needed to make a print is identified.

A black box is printed. X dot rows are printed with the minimum energy setting. The energy is stepped up and x dot rows are printed. The stepping up of the energy and printing x dot rows is repeated until the label is fully printed or until the maximum safe level for any media is reached. The media is then backed into the printer and the expected position of an energy change is calculated. Once the expected position is calculated, the media is single stepped out of the printer again and the black-mark sensor readings are sampled by the sensor. If a change is detected then the maximum useful energy has not yet been identified. The steps are repeated, until the sensor readings do not change. When no change is detected, the maximum useful energy to make a print has been identified.

By repeating this method between minimum energy and maximum energy setting a coarse energy setting is obtained. Preferably, the coarse energy setting is obtained through interpolation. However, mathematic methods or a combination of mathematic methods could be used. Alternatively, the maximum useful energy could be used as the coarse setting.

The sensor values are converted with an A/D-converter and stored as digital values for the numerical operations. Known devices capable of numerical operations such as those that be hard-coded at gate-level, ASIC, or CPU are preferably used.

Once the coarse energy setting is found, the second step involves fine-tuning the energy setting to find the optimal setting.

The printer is automatically set to the coarse value. The initial coarse setting is taken from the high value of the saturation setting that was previously detected. A small amount of energy may be added to ensure the printer is printing in the saturated region of the media printout.

A black box is printed using the coarse setting. The black box should have a width larger than the sensor beam. A step-by-step sampling of the leading and trailing edge of the box is done by the sensor, to obtain a gradient curve for leading and trailing edge of the printout.

Using the sensor, the trailing edge is measured to determine the undetectable "black" area. The steps are repeated with decreasingly lower energy settings until a "gradient" has been acquired. These steps are based on the leading and trailing edge slopes, adjustments are made to find the optimum point for balancing the slopes against each other.

Using the two sets of gradients and the optimum balance between the two is calculated. Balancing choices are dependent on the expected aspect of the printout the user want to achieve. Typically, the user wants to have the in gradient to be the same in both cases so the printout will be symmetrical relative to the position on the media. Repeat printing, sampling and adopting until the optimum point has been found.

A combination of other mathematical methods, including interpolation with slope angle optimization can be used to determine the optimum point. The optimal point is not usually in the middle of the range as the media often is logarithmic in behavior and non-linear thermal "white-to-black" behavior.

The printer is then set to found optimal value. The value can be either set automatically or manually. The settings can be reviewed by being presented in a display or a label can be printed the newly detected recommended settings.

the invention claimed is:

1. A method for automatic adjustment of media settings for a printer, comprising the steps of:

a. installing a media roll on the printer;

b. printing a box comprising the steps of:

printing a selected number of rows with a first energy, increasing the energy, printing the selected number of rows with the increased energy, repeating the increasing the energy and printing the selected number of rows steps until the box is complete or a maximum safe energy is reached;

c. sampling the box with a sensor;

d. determining if there is a change in print reflectance;

e. if there is a change in print reflectance determining the minimum or the maximum useful energy;

f. repeat steps b-e until the maximum useful energy is determined, wherein the first energy is equal to or greater than the energy used for the last printed row on the previous box;

g. after the minimum useful and maximum useful energy are determined, interpolating between the minimum and maximum useful energies to determine a coarse energy value;

h. setting the printer to the coarse energy value.

2. The method of claim 1 further comprising the steps of calculating the expected location on the box for each energy change before sampling the box.

3. The method of claim 2 wherein the media is single stepped out of the printer and the sampling the box step comprises sampling the box between each said energy change location.

4. The method of claim 1 wherein the minimum useful energy is determined by identifying the energy used to print the rows immediately after the location of the first change in reflectance.

5. The method of claim 1 wherein the maximum useful energy is determined by identifying the energy used to print the rows immediately after the last change in reflectance.

6. The method of claim 4 wherein the maximum useful energy is determined by identifying the energy used to print the rows immediately after the last change in reflectance.

7. The method of claim 6 further comprising the steps of calculating the expected location on the box for each energy change before sampling the box.

8. The method of claim 7 wherein the media is single stepped out of the printer and the sampling the box step comprises sampling the box between each said energy change location.

9. The method of claim 1 wherein the coarse energy setting is the maximum useful energy setting.

10. The method of claim 1 further comprising the steps of:

i. after the printer has been set to the coarse setting, printing a box comprising the steps of:

printing a selected number of rows with a first energy, decreasing the energy, printing the selected number of rows with the decreased energy, repeating the decreasing the energy and printing the selected number of rows steps until the box is complete or a minimum energy is reached;

j. sampling the box with a sensor;

k. determining if there is a change in print reflectance;

l. if there is a change in print reflectance determining gradient curves for the leading and trailing edges of the box;

m. repeat steps i-l until the minimum useful energy is reached, wherein the first energy is equal to or less than the energy used for the last printed row on the previous box;

n. obtain the slopes of the gradient curves and balance the slope of the gradient curves to obtain an optimal energy value; and o. setting the printer to the optimal energy value.

11. The method of claim 10 further comprising the step of calculating the expected location on the box for each energy change before sampling the box.

12. The method of claim 11 wherein the media is single stepped out of the printer and the sampling the box step comprises sampling the box between each said energy change location.

13. The method of claim 10 further comprising the step of displaying the optimal media setting.

14. The method of claim 10 further comprising the step of printing the optimal media setting.

15. A method of automatic adjustment of media settings for a printer comprising the steps of:

a. installing a media roll on the printer;

b. printing a box comprising the steps of:

printing a selected number of rows with a first energy, decreasing the energy, printing the selected number of rows with the decreased energy, repeating the decreasing the energy and printing the selected number of rows steps until the box is complete or a minimum energy is reached;

c. sampling the box with a sensor;

d. determining if there is a change in print reflectance;

e. if there is a change in print reflectance determining gradient curves for the leading and trailing edges of the box;

f. repeat steps b-e until the minimum useful energy is reached, wherein the first energy is equal to or less than the energy used for the last printed row on the previous box;

g. obtain the slopes of the gradient curves and balance the slope of the gradient curves to obtain an optimal energy value; and setting the printer to the optimal energy value.

16. A method of automatic adjustment of media settings for a printer comprising the steps of:

a. installing a media roll on the printer;

b. printing a box on the media comprising the steps of:

printing a selected number of rows with a first energy, increasing the energy, printing the selected number of rows with the increased energy, repeating the increasing the energy and printing the selected number of rows steps until the box is complete or a maximum safe energy is reached;

c. determining the location of the energy changes;

d. sampling the box with a sensor between each energy change location;

e. determining if there is a change in print reflectance;

f. if there is a change in print reflectance determining the minimum or the maximum useful energy;

g. repeat steps b-f until the maximum useful energy is determined, wherein the first energy is equal to or greater than the energy used for the last printed row on the previous box;

h. after the minimum useful and maximum useful energy are determined, interpolating between the minimum and maximum useful energies to determine a coarse energy value;

i. setting the printer to the coarse energy value;

j. printing a box comprising the steps of:

printing a selected number of rows with a first energy, decreasing the energy, printing the selected number of rows with the decreased energy, repeating the decreasing the energy and printing the selected number of rows steps until the box is complete or a minimum energy is reached;

k. determining the location of the energy changes;

l. sampling the box with a sensor between each energy change location;

m. determining if there is a change in print reflectance;

n. if there is a change in print reflectance determining gradient curves for the leading and trailing edges of the box;

o. repeat steps j-n until the minimum useful energy is reached, wherein the first energy is equal to or less than the energy used for the last printed row on the previous box;

p. obtain the slopes of the gradient curves and balance the slope of the gradient curves to obtain an optimal energy value; and q. setting the printer to the optimal energy value.

* * * * *